US007241120B2

(12) United States Patent
Bez et al.

(10) Patent No.: US 7,241,120 B2
(45) Date of Patent: Jul. 10, 2007

(54) PISTON MACHINE WITH PORTED PISTON HEAD

(75) Inventors: Eckard Bez, New Bern, NC (US); Thorsten Burggraf, Runkel (DE); Stefan Zabeschek, Asslar (DE)

(73) Assignee: Pfeiffer Vacuum GmbH, Asslar (DE)

( * ) Notice: Subject to any disclaimer, the term of this patent is extended or adjusted under 35 U.S.C. 154(b) by 618 days.

(21) Appl. No.: 10/680,992

(22) Filed: Oct. 8, 2003

(65) Prior Publication Data

US 2004/0071574 A1 Apr. 15, 2004

(30) Foreign Application Priority Data

Oct. 10, 2002 (DE) ..... 102 47 336

(51) Int. Cl.
*F04B 39/10* (2006.01)

(52) U.S. Cl. ..... 417/549; 417/505; 417/552

(58) Field of Classification Search ..... 417/545, 417/549, 552, 505, 555.1; 251/65, 129.15; 137/512.1
See application file for complete search history.

(56) References Cited

U.S. PATENT DOCUMENTS

| | | | | |
|---|---|---|---|---|
| 4,176,586 | A * | 12/1979 | Stoll et al. | 92/5 R |
| 4,377,090 | A * | 3/1983 | Seulen | 73/861.74 |
| 4,489,754 | A * | 12/1984 | Seessle et al. | 137/528 |
| 5,775,886 | A * | 7/1998 | Terwilliger | 417/553 |
| 6,019,080 | A * | 2/2000 | LaGrone | 123/193.6 |
| 6,120,266 | A * | 9/2000 | Teck | 417/553 |
| 6,585,500 | B2 * | 7/2003 | Park et al. | 417/549 |

* cited by examiner

*Primary Examiner*—Ehud Gartenberg
*Assistant Examiner*—Peter Bertheaud
(74) *Attorney, Agent, or Firm*—Abelman, Frayne & Schwab

(57) ABSTRACT

A piston machine includes a cylindrical wall (2) defining a swept volume (1) and having a plurality of gas inlet openings (5), and a piston (3) reciprocating in the swept volume (1), and the piston head (12) of which is formed as a valve having a plurality of openings (14) provided in the piston head (12), and a forcelocking device (16, 21; 18, 24) for retaining the plurality of openings (14) in one of their open condition and closed condition.

6 Claims, 3 Drawing Sheets

PISTON MACHINE WITH PORTED PISTON HEAD

BACKGROUND OF THE INVENTION

1. Field of the Invention

The present invention relates to a piston machine for delivering of gases, including a cylindrical wall defining a swept volume and having a plurality of gas inlet openings, a gas outlet valve, and a piston reciprocating in the swept volume and having a piston head.

2. Description of the Prior Art

Piston machines of the types described above are used, among others, in vacuum technology for delivery of gases and for generating and maintaining of a pressure difference, i.e., as vacuum pumps. A vacuum pump of this type is disclosed, e.g., in U.S. Pat. No. 5,921,755.

The present invention relates to one- or multi-stage constructions. In the piston machines of the above-described type, the piston reciprocates between the two dead points. During a return stroke of the piston, the gas is compressed and is expelled. During the return stroke, underpressure or vacuum is formed in the swept volume. As a result, the gases can flow into the swept volume through a suitable valve.

The work, which is produced during the return stroke of the piston is a result of a pressure difference between the pressure in the operational volume (space) of the piston and an underpressure in the swept volume (space). This work also depends on the surface of the piston (its size) and on the stroke length. The work produced during the return stroke of the piston increase the power consumption of the piston drive and leads to heating of the machine (pump) components, which adversely affect the operation of the machine and leads to increased friction losses. The removal of heat requires additional, undesirable expenses.

Accordingly, an object of the invention is to provide a piston machine in which an additional, unnecessary energy consumption and an undesirable heating of the machine components are eliminated.

Another object of the present invention is to provide a piston machine in which no dead volume is formed in the region of the pump active components (e.g., the piston, valves), which dead volume noticeably adversely affects the machine characteristics during the gas pumping process.

SUMMARY OF THE INVENTION

These and other objects of the present invention, which will become apparent hereinafter, are achieved by providing a piston machine of the type described above and in which the piston head is formed as a valve having a plurality of openings provided in the piston head, and a forcelocking device for retaining the plurality of openings in one of their open condition and closed condition, dependent on the gas flow through the forcelocking device.

In the piston machine according to the present invention, the amount of work produced during the return stroke is reduced. In addition, the pressure in the operational volume of the piston and the vacuum in the swept volume is reduced as a result of gases flowing through the piston head into the swept volume. This effect is achieved by forming the piston head as a valve. The openings, which are formed in the piston head, directly connect the operational volume of the piston with the swept volume. The flow of gas through the piston head permits to eliminate dead volumes and, thereby, insures an effective behavior of the piston machine.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 3:
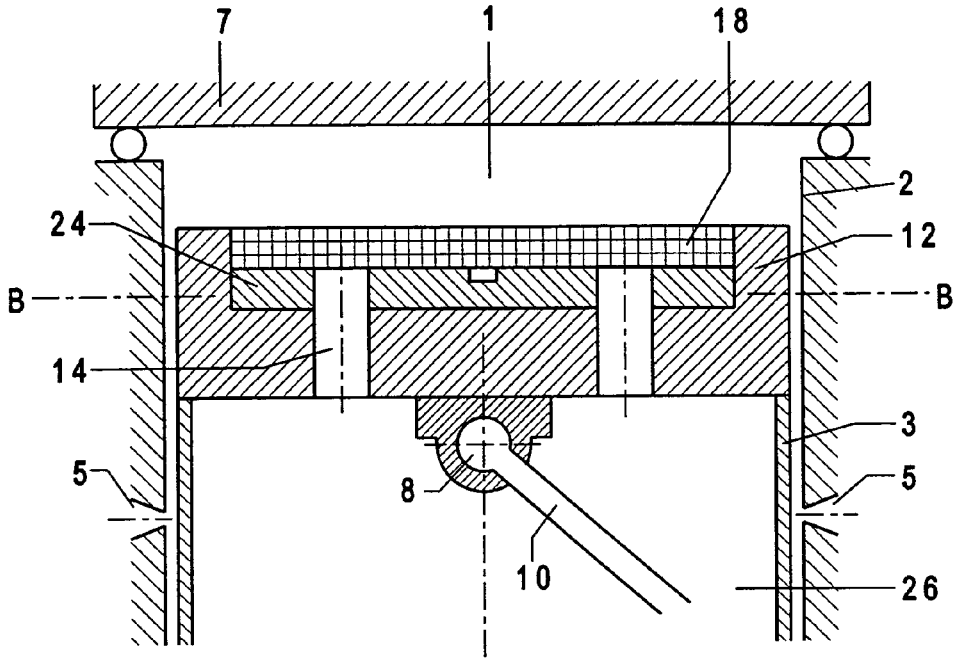
FIG. 3 a cross-sectional view of a suction side of a further embodiment of a piston machine according to the present invention.

A piston machine according to the present invention, which is realized as a piston pump, has a swept volume 1 which is limited by a cylindrical wall 2 of the piston pump and in which a piston 3 reciprocates for delivering a gas. The to-be-pumped gas enters through radial inlet openings 5 formed in the cylindrical wall 2 in the region of the lower pressure point of the piston 3, and is expelled through a valve 7 provided at the upper end of the swept volume 2. A conrod 8 and a piston rod 10, which are connected with a drive, provide for the reciprocating movement of the piston 3. The piston 3 is axially limited by a piston head 12. According to the present invention, the piston head 12 is formed as a valve. For functioning as a valve, the piston head 12 is formed with through-openings 14 which are covered by diaphragm 16 that, according to the present invention, is formed of a plastic material interspersed with magnetic particles, or as a magnetic plastic diaphragm 18 (FIG. 3).

Figure 1:
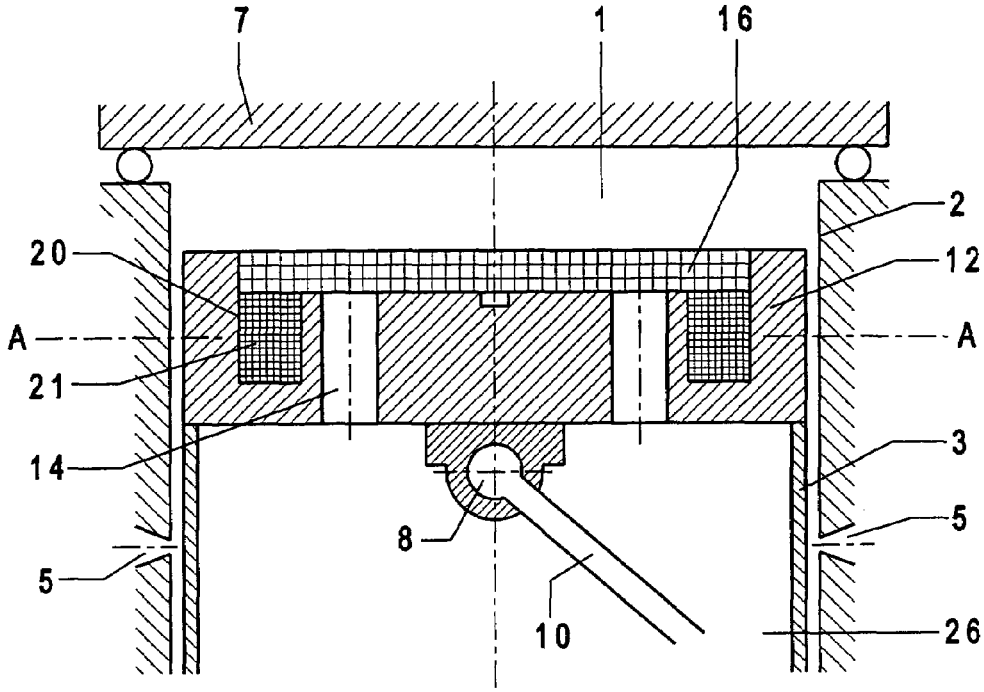
FIG. 1 a cross-sectional view of a suction side of a piston machine according to the present invention.
Figure 2:
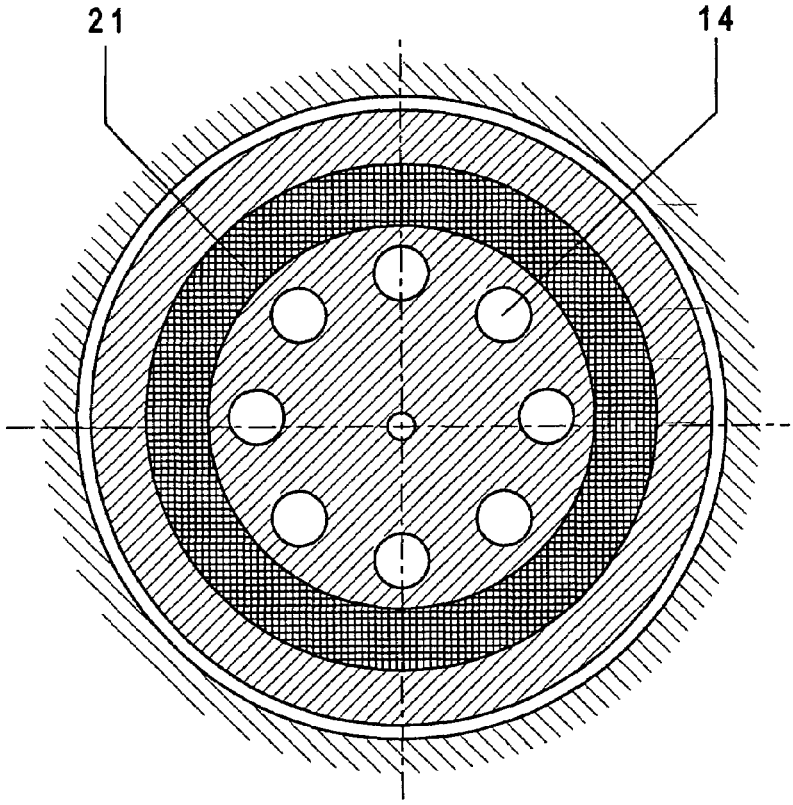
FIG. 2 a cross-sectional view along line A-A in FIG. 1.
Figure 2A:
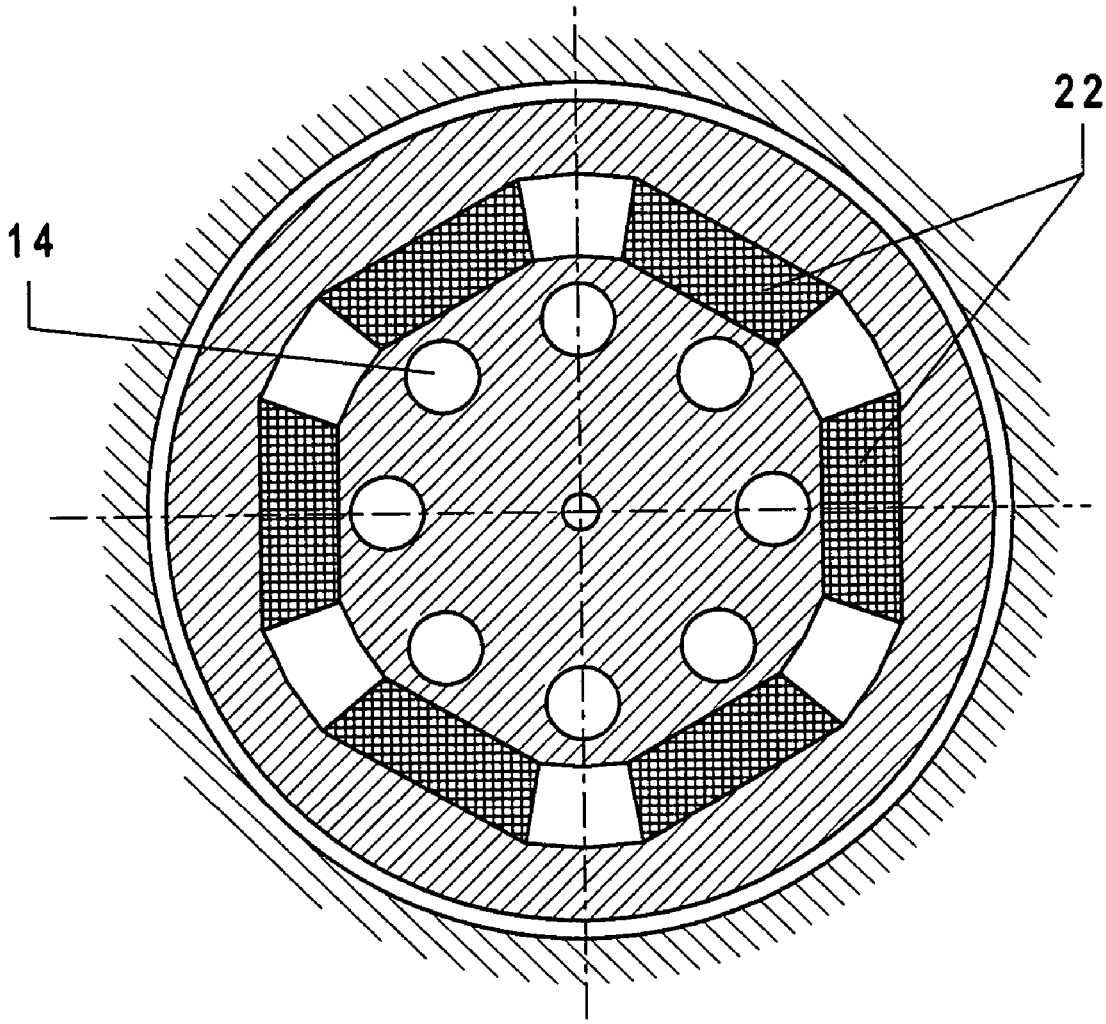
FIG. 2*a* a cross-sectional view similar to that shown in FIG. 2 of another embodiment of a piston machine according to the present invention.
Figure 4:
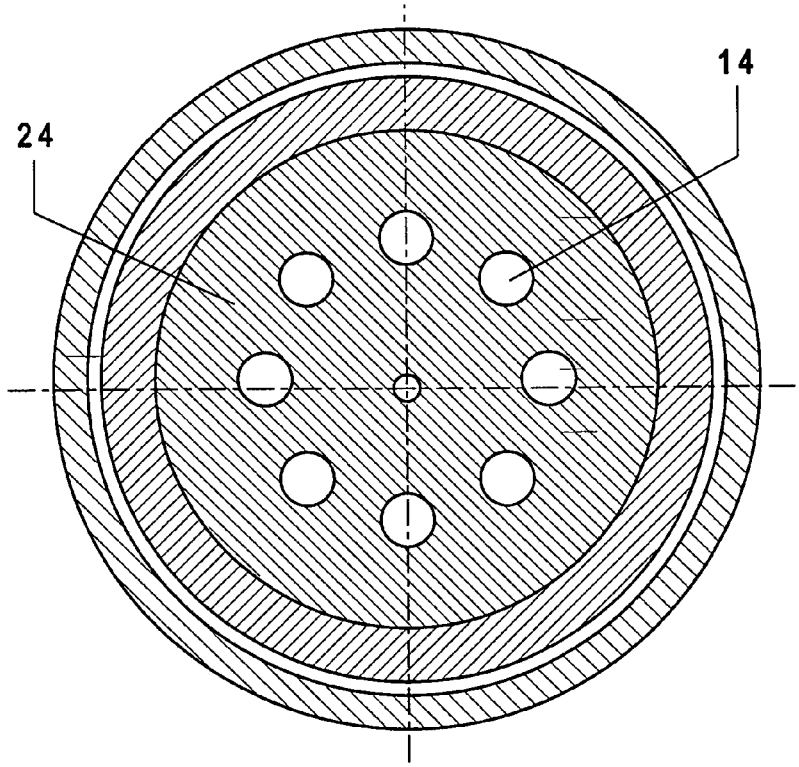
FIG. 4 a cross-sectional view along line B-B in FIG. 3.

For pressing the diaphragm toward the piston head 12 for sealing the openings 14 in the closed conditions of the valve, there is provided a forcelocking means. In the embodiment shown in FIG. 1, the forcelocking means includes a magnetic ring 21 or magnetic segments 22 (FIG. 2*a*) embedded in a groove 20 formed in the piston head 12. The magnetic ring 21 or the magnetic segments 22 cooperate with magnetic particle interspersed in the diaphragm material. In the embodiment shown in FIGS. 3-4, the forcelocking means includes a metal plate 24 that cooperates with the magnetic plastic diaphragm 18. The diaphragm 16 or 18 and the forcelocking means form a forcelocking device that provides for sealing of the openings 14.

When a return stroke begins, the openings 14 are sealed by the diaphragm 16 or 18 so that the gas, which has entered through the inlet opening 5, becomes compressed and after reaching a predetermined pressure, lifts the diaphragm 16 or 18 and is expelled through the openings 14. During the return stroke, the diaphragm 16 or 18 is lifted due to the pressure difference in the swept volume 1, in which underpressure prevails, and in an operational volume 26 of the piston 3, whereby a pressure equilibrium is obtained. The generated magnetic forces provide for a predetermined pressure difference that would insure a reliable adherence of the diaphragm 16 (18) and, thereby, a reliably sealing of the openings 14.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A piston machine, comprising a cylindrical wall (2) defining a swept volume (1) and having a plurality of gas inlet openings (5): a gas outlet valve (7); a piston (3) reciprocating in the swept volume (1) and having a piston head (12) formed as a valve having a plurality of openings (14) provided in the piston head (12); and magnetic force-locking means (16, 21; 18, 24) for retaining the plurality of openings (14) in one of open condition and closed condition thereof, dependent on the gas flow through the magnetic forcelocking means, and including a magnetic diaphragm (16) displaceable between a first position in which the magnetic diaphragm closes the plurality of openings (14), and an open positioning in which the plurality of openings are open, and a magnetic element (21, 22) for retaining the magnetic diaphragm (16, 18) in the first position thereof, the magnetic diaphragm being displaced into the open position thereof when a pressure force acting on the magnetic diaphragm as a result of a pressure difference between an operational volume of the piston machine and the swept volume, exceeds a magnetic force applied by the magnetic element to the magnetic diaphragm for retaining the magnetic diagram in the first position thereof.

2. A piston machine according to claim 1, wherein the diaphragm (16) is formed of a plastic material interspersed with magnetic particles.

3. A piston machine according to claim 1, wherein the diaphragm is formed as a magnetic plastic diaphragm (18).

4. A piston machine according to claim 1, wherein the magnetic element (21) comprises a annular permanent magnet (21) arranged in an annular groove (20) formed in the piston head (12).

5. A piston machine according to claim 1, wherein the magnetic element (22) comprises a plurality of segment-shaped permanent magnets arranged in an annular groove (20) formed in the piston head (12).

6. A piston machine according to claim 1, wherein the magnetic element comprises a metal plate (24) located in a recess formed in the piston head (12).

* * * * *